US008794988B2

(12) United States Patent
Tanaka

(10) Patent No.: US 8,794,988 B2
(45) Date of Patent: Aug. 5, 2014

(54) DETACHMENT PREVENTION COMPONENT AND ELECTRONIC DEVICE USING THE SAME

(75) Inventor: Shintaro Tanaka, Osaka (JP)

(73) Assignee: Panasonic Corporation, Osaka (JP)

( * ) Notice: Subject to any disclaimer, the term of this patent is extended or adjusted under 35 U.S.C. 154(b) by 157 days.

(21) Appl. No.: 13/545,531

(22) Filed: Jul. 10, 2012

(65) Prior Publication Data

US 2013/0017695 A1 Jan. 17, 2013

(30) Foreign Application Priority Data

Jul. 14, 2011 (JP) ..... 2011-155973
Jul. 4, 2012 (JP) ..... 2012-150608

(51) Int. Cl.
*H01R 13/62* (2006.01)
*H01R 13/24* (2006.01)
*H01R 12/83* (2011.01)
*H01R 13/639* (2006.01)

(52) U.S. Cl.
CPC ..... *H01R 13/6397* (2013.01); *H01R 13/24* (2013.01); *H01R 12/83* (2013.01)
USPC ..... 439/326

(58) Field of Classification Search
CPC ..... H01R 23/682; H01R 23/7005; H01R 23/7026; H01R 23/7073
USPC ..... 439/326, 541.5
See application file for complete search history.

(56) References Cited

U.S. PATENT DOCUMENTS

2002/0009941 A1* 1/2002 Clark et al. ..... 442/361

FOREIGN PATENT DOCUMENTS

JP 2005-293990 10/2005

* cited by examiner

*Primary Examiner* — Phuong Dinh
(74) *Attorney, Agent, or Firm* — Hamre, Schumann, Mueller & Larson, P.C.

(57) ABSTRACT

Since a connector device 30 has a cover component 60 mounted thereto, and the cover component 60 includes a first restraining section 62*a* and a second restraining section 62*b*, displacements of a first holding component 33 and a second holding component 34 can be restrained. Therefore, even if the connector device 30 is subjected to impact or shaking from the outside, the first holding component 33 and the second holding component 34 are not disengaged from a memory module 20, and easy detachment of the memory module 20 from a first connector body 31 can be prevented. Further, the memory module 20 projects from an opening of a casing when the connector device 30 having the structure as described above is mounted to an electronic device. Therefore, addition or exchange of the memory module 20 is facilitated.

3 Claims, 18 Drawing Sheets

DETACHMENT PREVENTION COMPONENT AND ELECTRONIC DEVICE USING THE SAME

BACKGROUND

1. Field

The present disclosure relates to a detachment prevention component and an electronic device using a dropping prevention component.

2. Description of the Related Art

An information processing device such as a notebook computer often includes a RAM (Random Access Memory) that temporarily stores data when a central processing unit executes various information processes. In recent years, a SIMM (Single Inline Memory Module) and a DIMM (Dual Inline Memory Module) each of which has memory chips mounted to the front side and the back side of a printed board are often used as the RAM. A memory module as described above is electrically and mechanically mounted to a connector which is mounted to a main printed board in the information processing device, to function as a RAM.

Japanese Laid-Open Patent Publication No. 2005-293990 discloses that a locking component is mounted to a connector body to which a memory module is connected, to restrain, by means of the locking component, movement of the memory module in a disconnection direction, and a locking piece of the locking component is engaged with and locked in the connector body to restrain movement of the locking component in the direction in which the locking component is disengaged, and the locking piece of the locking component is covered by a reinforcing plate from the outside so as to disable an unlocking operation, so that the connector body and the memory module are less likely to be easily disconnected from each other, and connection reliability relative to impact and shaking can be enhanced, and malfunction or erroneous operation caused by, for example, the memory module of an electronic device being intentionally removed and replaced with another memory module can be effectively prevented.

SUMMARY

However, in the structure disclosed in Japanese Laid-Open Patent Publication No. 2005-293990, when a connector includes a plurality of connector bodies, the number of the locking components needs to be equal to the number of the connector bodies. Therefore, the number of components is increased, and a problem arises that cost is increased.

According to the present disclosure, a dropping prevention component capable of preventing detachment of electric circuit modules mounted to a plurality of connector bodies, a connector device including the dropping prevention component, and an electronic device including the connector device, are provided.

A detachment prevention component according to the present disclosure is a detachment prevention component which is mountable to a connector device that includes: a connector body capable of holding a subject to be connected; an electrical contact, included in the connector body, having an elasticity with which the subject to be connected can be urged in a disconnection direction; and at least a pair of holding components, included in the connector body, each having a locking portion for restraining the subject to be connected from moving in the disconnection direction, and the detachment prevention component includes: a fixing section secured to the connector body; and a restraining section for restraining displacement of the holding components in a direction in which the locking portion disengages from the subject to be connected.

An electronic device according to the present disclosure includes: a casing; a connector body, disposed in the casing, capable of holding a subject to be connected; a lid component, disposed on an outer surface of the casing so as to be openable and closable, for covering the connector body in a closed state; an electrical contact, included in the connector body, having an elasticity with which the subject to be connected can be urged in a disconnection direction; at least a pair of holding components, included in the connector body, each having a locking portion for restraining the subject to be connected from moving in the disconnection direction; and a detachment prevention component secured to the connector body. The detachment prevention component includes: a fixing section secured to the connector body; and a restraining section for restraining displacement of the holding components in a direction in which the locking portion disengages from the subject to be connected, and the locking portion cancels the restraining of the displacement when the lid component is in a opened state.

DETAILED DESCRIPTION

Hereinafter, an embodiment will be described in detail with reference to the drawings as necessary. However, unnecessarily detailed description may not be given. For example, matters that have been already well known may not be described in detail or substantially the same components may not be repeatedly described. This is because the following description is prevented from being redundant, in order to allow a person of ordinary skill in the art to easily understand the embodiment.

The applicant provides the following description and the accompanying drawings in order to allow a person of ordinary skill in the art to sufficiently understand the present disclosure, and the description and the drawings are not intended to restrict the subject matter of the scope of claim for patent.

(First Embodiment)

[1. Structure of Electronic Device]

Figure 1:
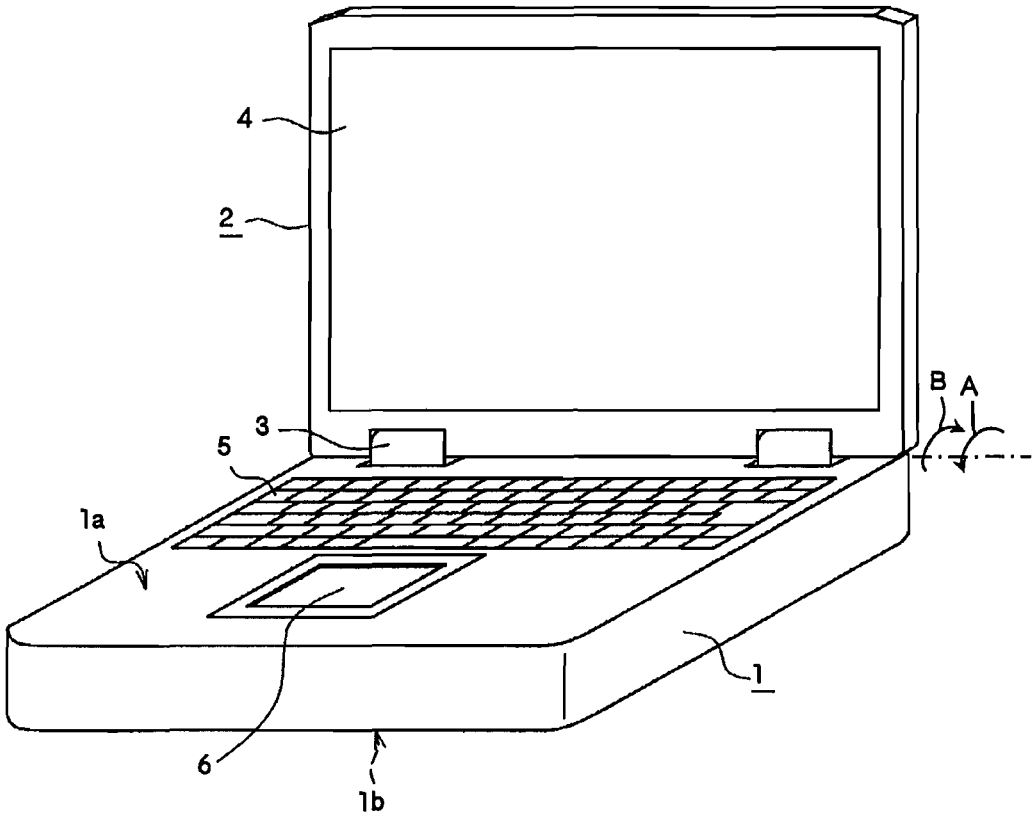
FIG. 1 is a perspective view of a notebook computer.

FIG. 1 is a perspective view illustrating an outer appearance of a notebook computer according to the present embodiment. The notebook computer shown in FIG. 1 is an exemplary electronic device. In the present embodiment, a notebook computer will be described as an exemplary electronic device. However, the structure of the present disclosure is applicable to an electronic device which includes at least a connector to which an electric circuit module such as a memory module can be detachably mounted.

As shown in FIG. 1, the notebook computer includes a first casing 1 and a second casing 2. The first casing 1 has incorporated therein a circuit board to which various electric components are mounted, a central processing unit, and the like. The second casing 2 includes a display panel 4. The display panel 4 may be implemented as, for example, a liquid crystal display panel. The first casing 1 and the second casing 2 are supported by a hinge section 3 so as to be pivotable relative to each other. The hinge section 3 includes a rotation axis about which the first casing 1 and the second casing 2 are supported so as to be rotatable in the direction indicated by an arrow A or B. On a top surface 1*a* of the first casing 1, a keyboard 5 and a pointing device 6 are disposed.

Figure 2:
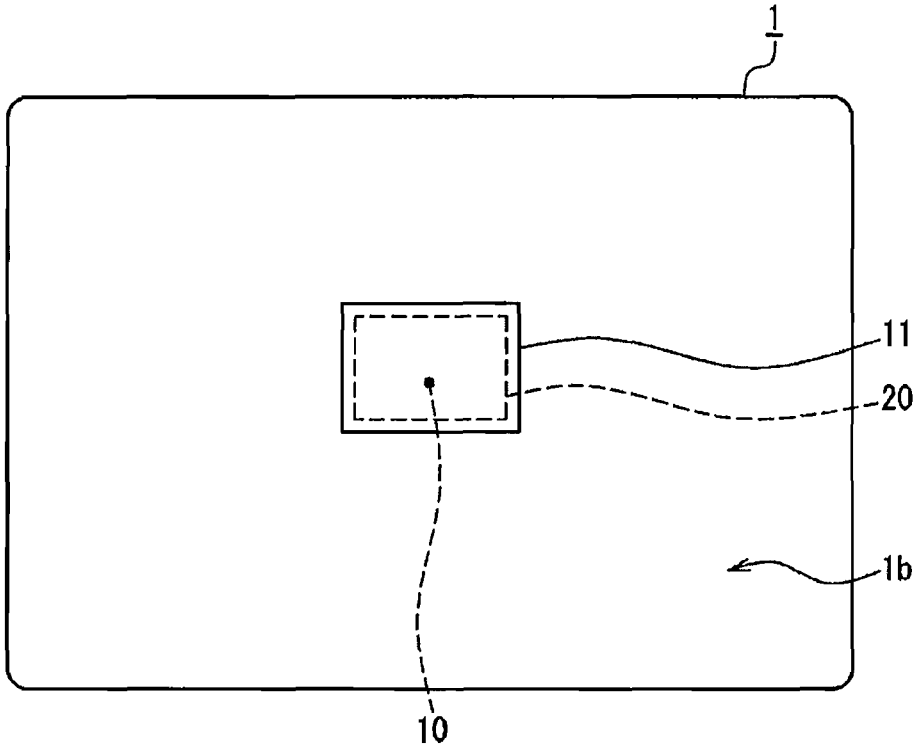
FIG. 2 is a plan view of a structure of a bottom surface of the notebook computer.

FIG. 2 is a plan view illustrating a structure of a bottom surface 1*b* side of the first casing 1. The bottom surface 1*b* of the first casing 1 is a reverse side surface of the top surface 1*a*. The bottom surface 1*b* of the first casing 1 has an opening 10 formed therein. Inside the opening 10, a connector device (described below) to which a memory module 20 is detachably mounted is accommodated. The opening 10 is openable and closable by means of a lid component 11.

[2. Structure of Connector Device 30]

Figure 3A:
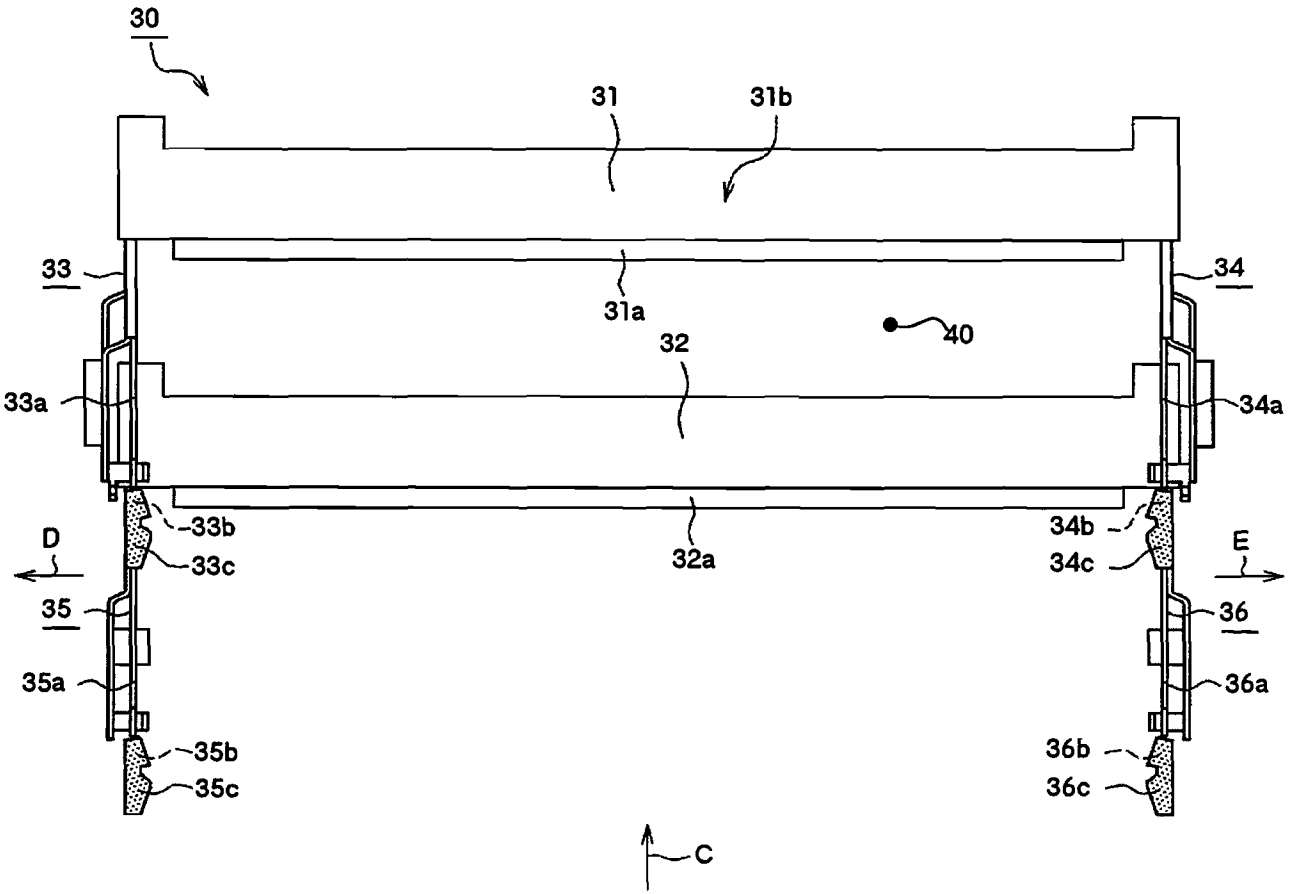
FIG. 3A is a plan view of a connector device.
Figure 3B:
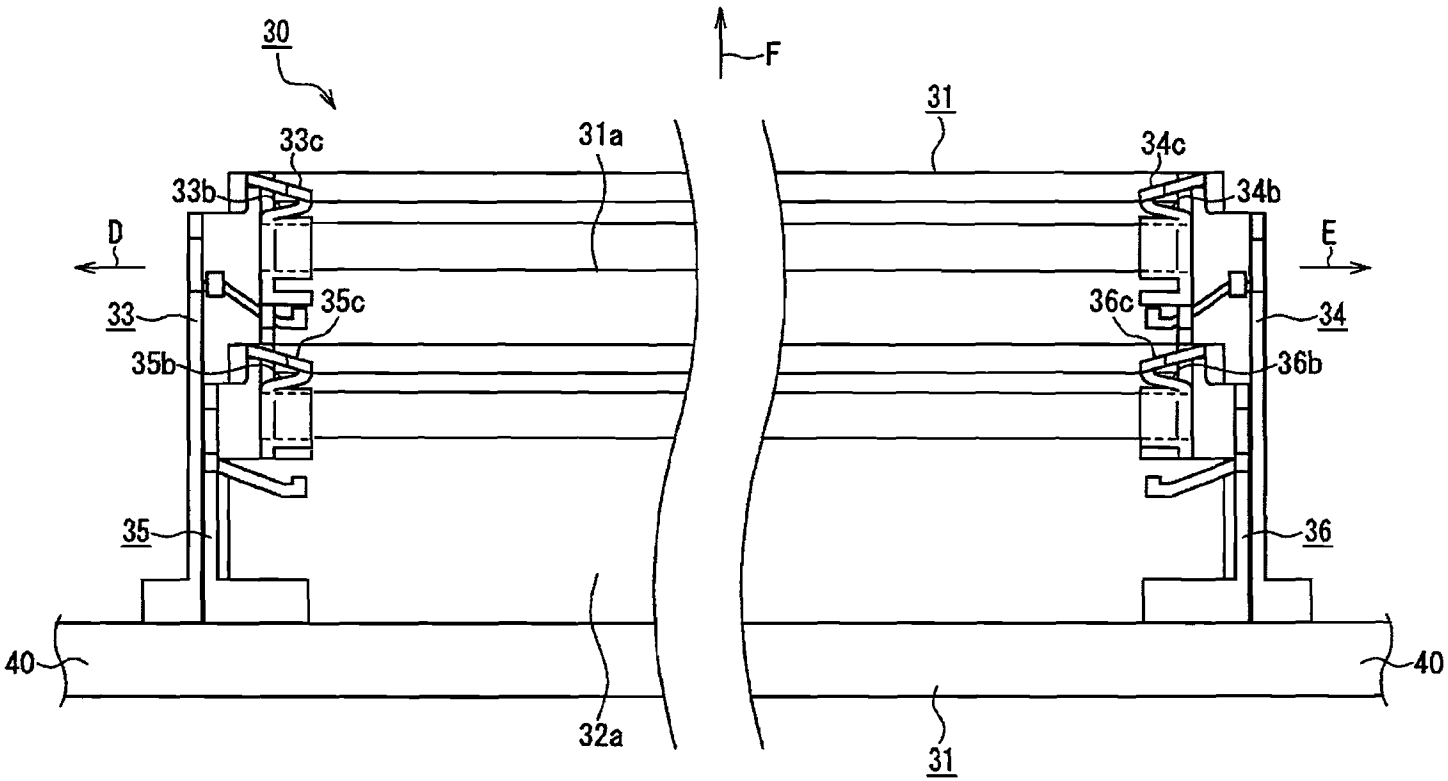
FIG. 3B is a front view of the connector device.

FIG. 3A is a plan view of the connector device according to the present embodiment. FIG. 3B is a front view of the connector device according to the present embodiment.

A connector device 30 is disposed inside the opening 10 shown in FIG. 2. The connector device 30 includes a first connector body 31, a second connector body 32, a first holding component 33, a second holding component 34, a third holding component 35, and a fourth holding component 36.

In general, for the notebook computers to be distributed, the memory module 20 is mounted to only the second connector body 32 by a manufacturer thereof, and no memory module is mounted to the first connector body 31, in many cases. In this case, a user is allowed to optionally mount a new memory module to the first connector body 31, thereby enabling a total capacity of a memory of the notebook computer to be increased. Further, for the notebook computers to be distributed, the memory module 20 is mounted to each of the first connector body 31 and the second connector body 32 by the manufacturer thereof in some cases.

The first connector body 31 is mounted to a printed board 40 as shown in FIG. 3B. The first connector body 31 can hold the memory module 20. The first connector body 31 includes a slot through which the memory module 20 can be inserted. The first connector body 31 includes a plurality of contacts 31*a* that are electrically connectable to a plurality of terminals of the memory module 20. The contacts 31*a* may have the same structure as disclosed in, for example, Japanese Laid-Open Patent Publication No. 2005-293990.

The second connector body 32 is mounted to the printed board 40 as shown in FIG. 3B. The second connector body 32 can hold the memory module 20. The second connector body 32 includes a slot through which the memory module 20 can be inserted. The second connector body 32 includes a plurality of contacts 32*a* that are electrically connectable to a plurality of terminals of the memory module 20. The contacts 32*a* may have the same structure as disclosed in, for example, Japanese Laid-Open Patent Publication No. 2005-293990.

In the present embodiment, the number of the contacts 31*a* of the first connector body 31 and the number of the contacts 32*a* of the second connector body 32 are equal to each other, and the size of the slot is the same between the first connector body 31 and the second connector body 32. However, connectors having specifications different from each other may be used. The first connector body 31 and the second connector body 32 are disposed so as to be shifted from each other in the surface direction of the mounting surface of the printed board 40 as shown in FIG. 3A. The first connector body 31 and the second connector body 32 are disposed so as to be shifted from each other in a direction orthogonal to the mounting surface of the printed board 40 as shown in FIG. 3B.

The first holding component 33 is secured to one end portion, of the first connector body 31, in the longitudinal direction of the first connector body 31. The first holding component 33 includes an arm portion 33*a*, a locking portion 33*b*, and an operation piece 33*c*. The arm portion 33*a* is formed so as to extend, parallel to the mounting surface of the printed board 40, from the side surface of the first connector body 31. The arm portion 33*a* has one end portion secured to the first connector body 31. The arm portion 33*a* is formed so as to be elastically deformable in a direction indicated by an arrow D in a state shown in FIG. 3A. The arm portion 33*a* is formed of an elastically deformable material in an elastically deformable shape. For example, the arm portion 33*a* may be formed of a metal such as a stainless steel in a thin-plate-like shape. The locking portion 33*b* is formed near the other end portion of the arm portion 33*a*. The locking portion 33*b* projects toward the second holding component 34 as shown in FIG. 3B. The locking portion 33*b* is allowed to abut against one of the surfaces of the memory module 20, and locks the memory module 20 in a normal mounting position in an engaged state. Specifically, the locking portion 33*b* can restrain displacement of the memory module 20 in a direction indicated by an arrow F. The operation piece 33*c* is formed at the other end portion of the arm portion 33*a*. The operation piece 33*c* is a portion to be held by a user with her/his finger for elastically deforming the first holding component 33 in the direction indicated by the arrow D.

The second holding component 34 is secured to the other end portion, of the first connector body 31, in the longitudinal direction of the first connector body 31. The second holding component 34 includes an arm portion 34*a*, a locking portion 34*b*, and an operation piece 34*c*. The arm portion 34*a* is formed so as to extend, parallel to the mounting surface of the printed board 40, from the side surface of the first connector body 31. The arm portion 34*a* has one end portion secured to the first connector body 31. The arm portion 34*a* is formed so as to be elastically deformable in a direction indicated by an arrow E in the state shown in FIG. 3A. The arm portion 34*a* is formed of an elastically deformable material in an elastically deformable shape. For example, the arm portion 34a may be formed of a metal such as a stainless steel in a thin-plate-like shape. The locking portion 34*b* is formed near the other end portion of the arm portion 34*a*. The locking portion 34*b* projects toward the first holding component 33 as shown in FIG. 3B. The locking portion 34*b* is allowed to abut against the one of the surfaces of the memory module 20, and locks the memory module 20 in a normal mounting position in an engaged state. Specifically, the locking portion 34*b* can restrain displacement of the memory module 20 in the direction indicated by the arrow F. The operation piece 34*c* is formed at the other end portion of the arm portion 34*a*. The operation piece 34*c* is a portion to be held by a user with her/his finger for elastically deforming the second holding component 34 in the direction indicated by the arrow E.

The third holding component 35 is secured to one end portion, of the second connector body 32, in the longitudinal direction of the second connector body 32. The third holding component 35 includes an arm portion 35*a*, a locking portion 35*b*,and an operation piece 35*c*. The arm portion 35*a* is formed so as to extend, parallel to the mounting surface of the printed board 40, from the side surface of the second connector body 32. The arm portion 35*a* has one end portion secured to the second connector body 32. The arm portion 35*a* is formed so as to be elastically deformable in the direction indicated by the arrow D in the state shown in FIG. 3A. The arm portion 35*a* is formed of an elastically deformable material in an elastically deformable shape. For example, the arm portion 35*a* may be formed of a metal such as a stainless steel in a thin-plate-like shape. The locking portion 35*b* is formed near the other end portion of the arm portion 35*a*. The locking portion 35*b* projects toward the fourth holding component 36 as shown in FIG. 3B. The locking portion 35*b* is allowed to abut against the one of the surfaces of the memory module 20, and locks the memory module 20 in a normal mounting position in an engaged state. Specifically, the locking portion 35*b* can restrain displacement of the memory module 20 in the direction indicated by the arrow F. The operation piece 35*c* is formed at the other end portion of the arm portion 35*a*. The operation piece 35*c* is a portion to be held by a user with her/his finger for elastically deforming the third holding component 35 in the direction indicated by the arrow D.

The fourth holding component 36 is secured to the other end portion, of the second connector body 32, in the longitudinal direction of the second connector body 32. The fourth holding component 36 includes an arm portion 36*a*, a locking portion 36*b*, and an operation piece 36*c*. The arm portion 36*a* is formed so as to extend, parallel to the mounting surface of the printed board 40, from the side surface of the second connector body 32. The arm portion 36*a* has one end portion secured to the second connector body 32. The arm portion 36*a* is formed so as to be elastically deformable in the direction indicated by the arrow E in the state shown in FIG. 3A. The arm portion 36*a* is formed of an elastically deformable material in an elastically deformable shape. For example, the arm portion 36*a* may be formed of a metal such as a stainless steel in a thin-plate-like shape. The locking portion 36*b* is formed near the other end portion of the arm portion 36*a*. The locking portion 36*b* projects toward the third holding component 35 as shown in FIG. 3B. The locking portion 36*b* is allowed to abut against the one of the surfaces of the memory module 20, and locks the memory module 20 in a normal mounting position in an engaged state. Specifically, the locking portion 36*b* can restrain displacement of the memory module 20 in the direction indicated by the arrow F. The operation piece 36*c* is formed at the other end portion of the arm portion 36*a*. The operation piece 36*c* is a portion to be held by a user with her/his finger for elastically deforming the fourth holding component 36 in the direction indicated by the arrow E.

Figure 4:
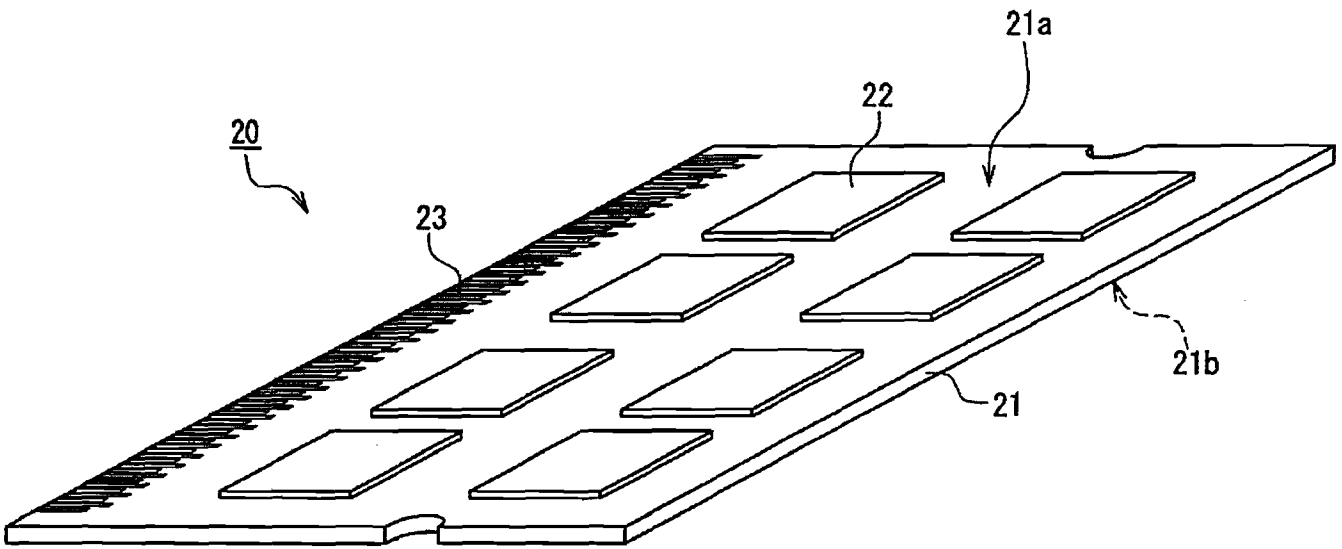
FIG. 4 is a perspective view of a memory module.

FIG. 4 is a perspective view of the memory module 20. The memory module 20 includes a printed board 21, memory chips 22, and contacts 23. The printed board 21 is formed as a resin substrate having an almost rectangular shape. Each memory chip 22 is a chip in which various data can be temporarily stored. The memory chips 22 are mounted on both one main surface 21*a* of the printed board 21 and the other main surface 21*b* thereof. In the present embodiment, a plurality of the memory chips 22 are mounted to the printed board 21. However, the number of the memory chips 22 mounted thereto is not limited to any specific number. Although, in the present embodiment, the memory chips 22 are mounted to each of the one main surface 21*a* of the printed board 21 and the other main surface 21*b* thereof (the memory chips 22 mounted to the other main surface 21*b* are not shown), the memory chips 22 may be mounted on one of the main surfaces depending on the mounting of the memory chips 22 to the printed board 21. A plurality of the contacts 23 are formed along one of long sides of the printed board 21. The contacts 23 are electrically connected to the memory chips 22 via a wiring pattern (not shown) formed in the printed board 21. The contacts 23 are electrically connected to the contacts 31*a* or the contacts 32*a* of the connector device 30 when the memory module 20 is mounted to the connector device 30. Although, in the present embodiment, the contacts 23 are formed on each of the one main surface 21*a* and the other main surface 21*b* of the printed board 21 (the contacts 23 formed on the other main surface 21*b* are not shown), the contacts 23 may be mounted to one of the main surfaces depending on the mounting of the memory chips 22 to the printed board 21.

Hereinafter, an operation for mounting the memory module 20 to the connector device 30 will be described.

Figure 5A:
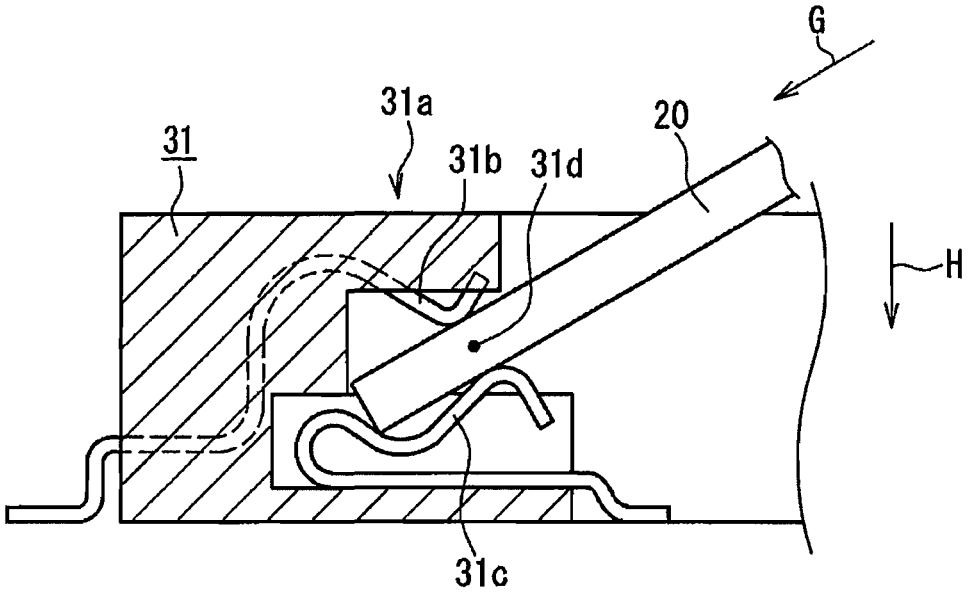
FIG. 5A is a cross-sectional view of a first connector body.
Figure 5B:
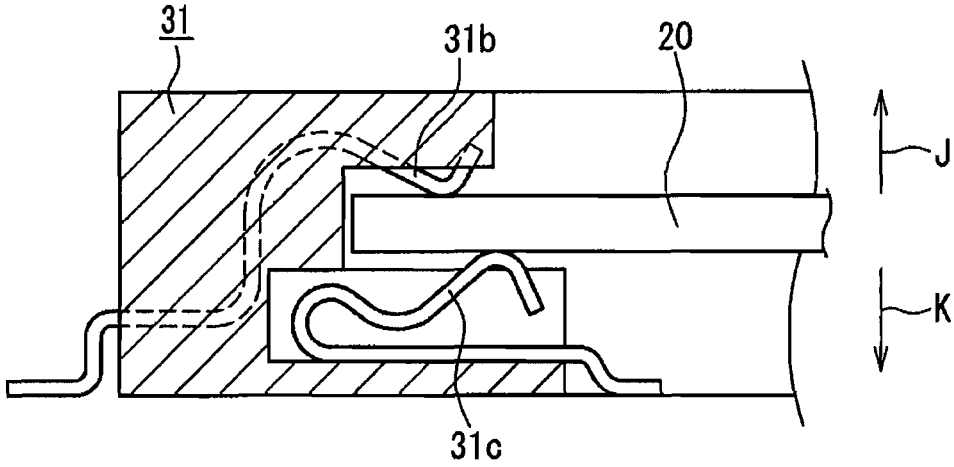
FIG. 5B is a cross-sectional view of the first connector body.

FIG. 5A is a cross-sectional view illustrating a state in which the memory module 20 is inserted into the connector device 30. FIG. 5B is a cross-sectional view illustrating a state in which the memory module 20 is mounted into a normal position in the connector device 30.

As shown in FIG. 5A and FIG. 5B, each contact 31*a* includes a first contact 31*b* and a second contact 31*c*. In the present embodiment, the connector device 30 includes the first contact 31*b* and the second contact 31*c* since the memory module 20 (DIMM) having the contacts 23 formed on both surfaces of the printed board 21 is mountable to the connector device 30. However, in a case where a memory module (SIMM) having the contacts 23 formed on only one surface of the printed board 21 is mountable, one of the first contact 31*b* or the second contact 31*c* may be provided. The first contact 31*b* and the second contact 31*c* are elastically deformable. A gap 31*d* into which the memory module 20 can be inserted is formed between the first contact 31*b* and the second contact 31*c*. The size of the gap 31*d* is slightly less than the thickness of the printed board 21 of the memory module 20, thereby enabling the memory module 20 to be held.

In order to mount the memory module 20 to the connector device 30, the memory module 20 is initially displaced as indicated by an arrow G, and inserted into the connector device 30 from the diagonal direction as shown in FIG. 5A. Specifically, a long side portion on which the contacts 23 of the memory module 20 are formed is inserted into the gap 31*d* between the first contact 31*b* and the second contact 31*c*. The memory module 20 having been inserted into the gap 31*d* is held between the first contact 31*b* and the second contact 31*c* since the size of the gap 31*d* is slightly less than the thickness of the memory module 20, and the first contact 31*b* and the second contact 31*c* support the printed board 21 at different positions in the surface direction of the main surface 21*a*, so that the memory module 20 maintains the tilted position as shown in FIG. 5A.

Next, the memory module 20 is displaced from a position shown in FIG. 5A in a direction indicated by an arrow H. At this time, since one of the long side portions of the memory module 20 is held between the first contact 31*b* and the second contact 31*c*, when the memory module 20 is displaced in the direction indicated by the arrow H, the memory module 20 rotates, while sliding, about a contact, acting as a fulcrum, between the contacts 23 of the memory module 20, and the first contact 31*b* or the second contact 31*c*.

The memory module 20 is displaced to a position shown in FIG. 5B, and is engaged with the locking portions 33*b* and 34*b*, thereby locking the memory module 20 in a normal position in the connector device 30 in an engaged state. At this time, the first contact 31*b* is elastically deformed in a direction indicated by an arrow J as shown in FIG. 5B, and the second contact 31*c* is elastically deformed in a direction indicated by an arrow K as shown in FIG. 5B.

The memory module 20 can be mounted to the second connector body 32 in the same manner as described above.

Figure 6:
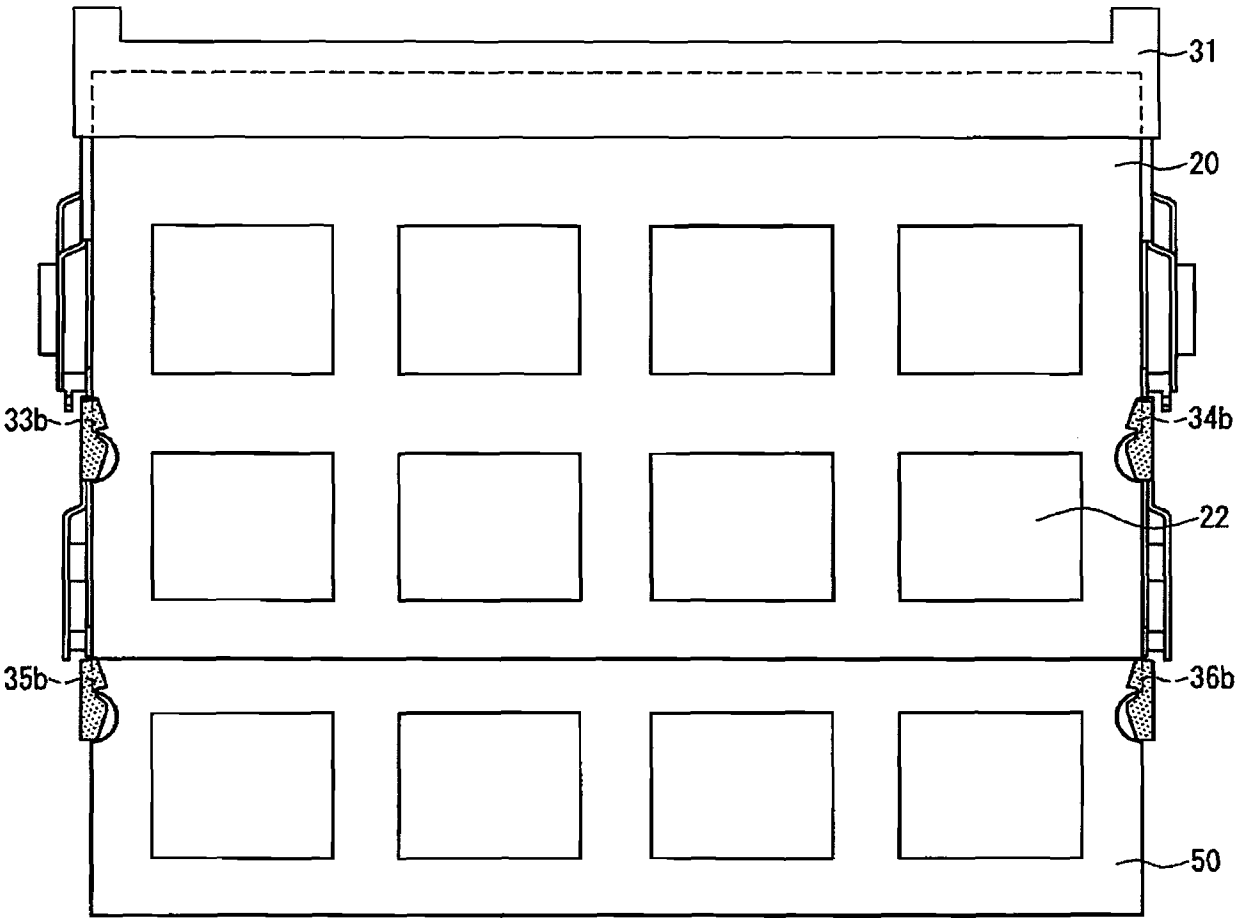
FIG. 6 is a plan view of the connector device to which the memory module is mounted.
Figure 7:
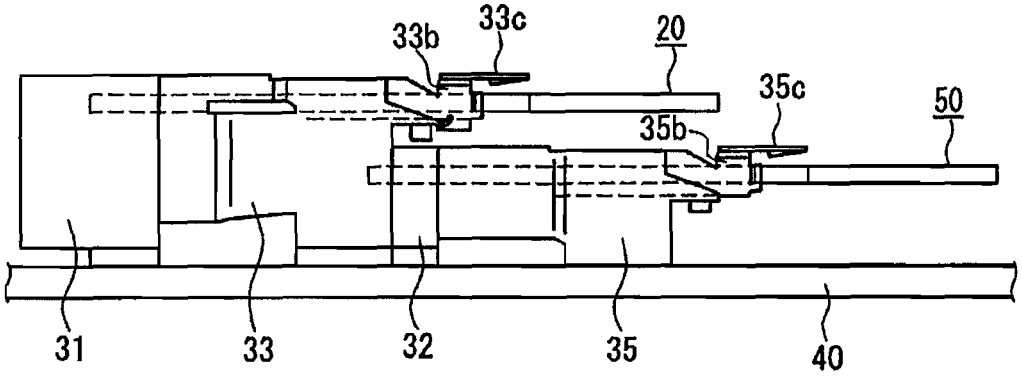
FIG. 7 is a side view of the connector device to which the memory module is mounted.
Figure 8:
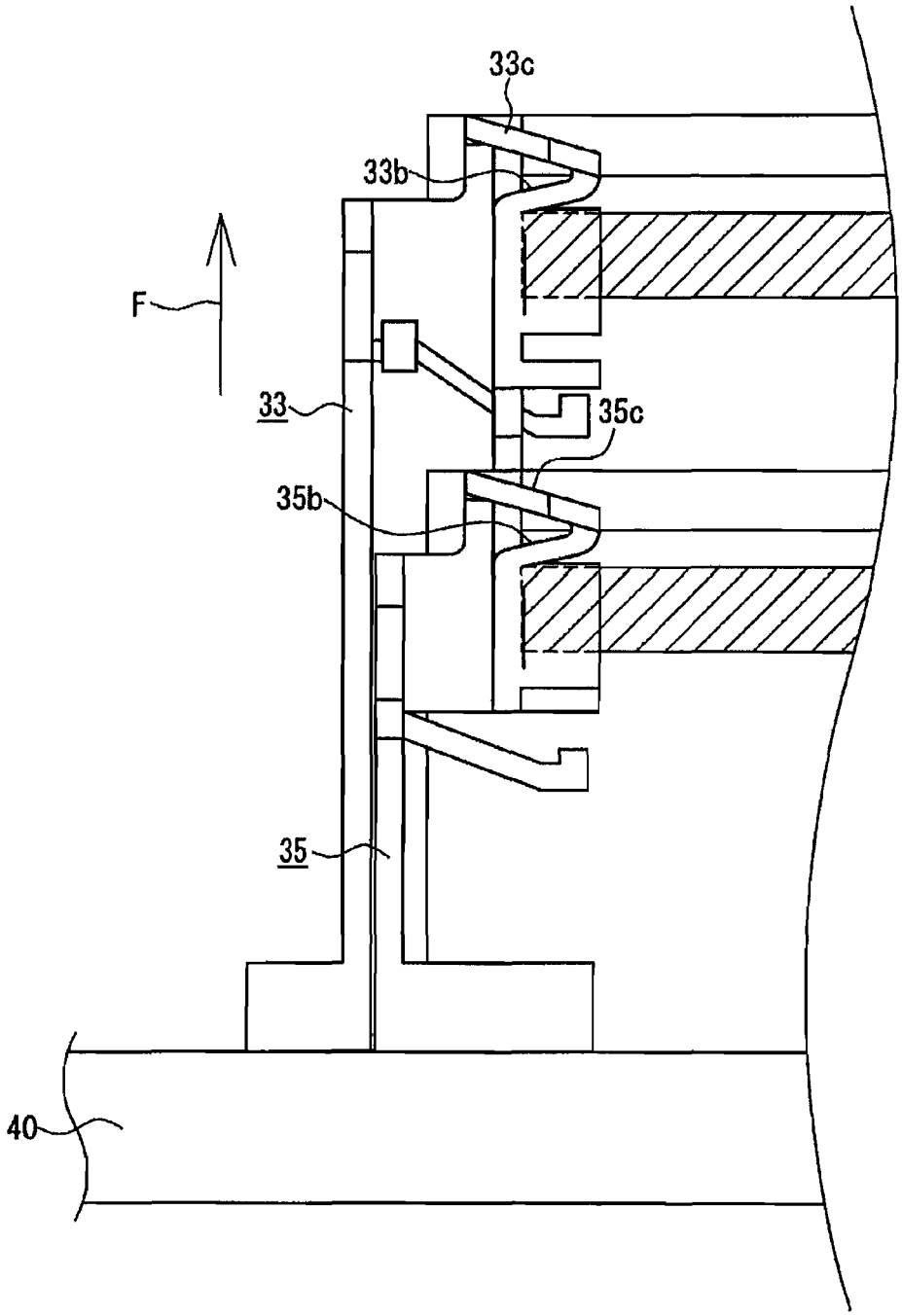
FIG. 8 is an enlarged cross-sectional view of the connector device to which the memory module is mounted.

FIG. 6 is a plan view illustrating a state in which memory modules are mounted to the first connector body 31 and the second connector body 32, respectively, as viewed from the first connector body 31 side. FIG. 7 is a side view illustrating a state in which the memory modules are mounted to the first connector body 31 and the second connector body 32, respectively. FIG. 8 is a partial front view illustrating a vicinity of the first holding component 33 and the third holding component 35.

In FIG. 6 to FIG. 8, an exemplary case is shown in which the memory module 20 is mounted to the first connector body 31 and a memory module 50 is mounted to the second connector body 32. However, at least a portion in which the memory module 20 is mounted to the connector device 30 and a portion in which the memory module 50 is mounted to the connector device 30 may have the same shape. Capacities of memory chips mounted, and the like may be different between in the memory module 20 and in the memory module 50. Therefore, the memory module 20 can be mounted to the second connector body 32, and the memory module 50 can be mounted to the first connector body 31. As shown in FIG. 6 to FIG. 8, the memory module 20 is locked in an engaged state by the locking portion 33*b* of the first holding component 33 and the locking portion 34*b* of the second holding component 34, to restrain displacement of the memory module 20 in the direction indicated by the arrow F. Further, the memory module 50 is locked in an engaged state by the locking portion 35*b* of the third holding component 35 and the locking portion 36*b* of the fourth holding component 36, to regulate the displacement of the memory module 50 in the direction indicated by the arrow F.

In the state shown in FIG. 6 to FIG. 8, if the connector device 30 is subjected to impact or shaking from the outside, at least one of the first holding component 33 and the second holding component 34 is likely to be displaced in the direction indicated by the arrow D or the arrow E (see FIG. 3B). When at least one of the first holding component 33 and the second holding component 34 is displaced, the memory module 20 may be disengaged from the locking portions 33*b* and 34*b*. If the memory module 20 is disengaged from the locking portions 33*b* and 34*b*, the memory module 20 may be displaced to the tilted position shown in FIG. 5A due to a pressing force of the first contact 31*b* in the direction indicated by the arrow K, and a pressing force of the second contact 31*c* in the direction indicated by the arrow J (see FIG. 5B). When the memory module 20 is in the position shown in FIG. 5A, electrical connection between the contacts 23 of the memory module 20 and the contacts 31*a* of the first connector body 31 is likely to become unstable. The same problem may arise in the memory module 50 which is connected to the second connector body 32, which is not described and shown.

In the present embodiment, a cover component 60 is provided for preventing, even if the connector device 30 is subjected to impact or shaking from the outside, electrical connection between the contacts 23 of the memory module 20 and the contacts 31*a* of the first connector body 31 from becoming unstable.

[3. Structure of Cover Component 60]

Figure 9A:
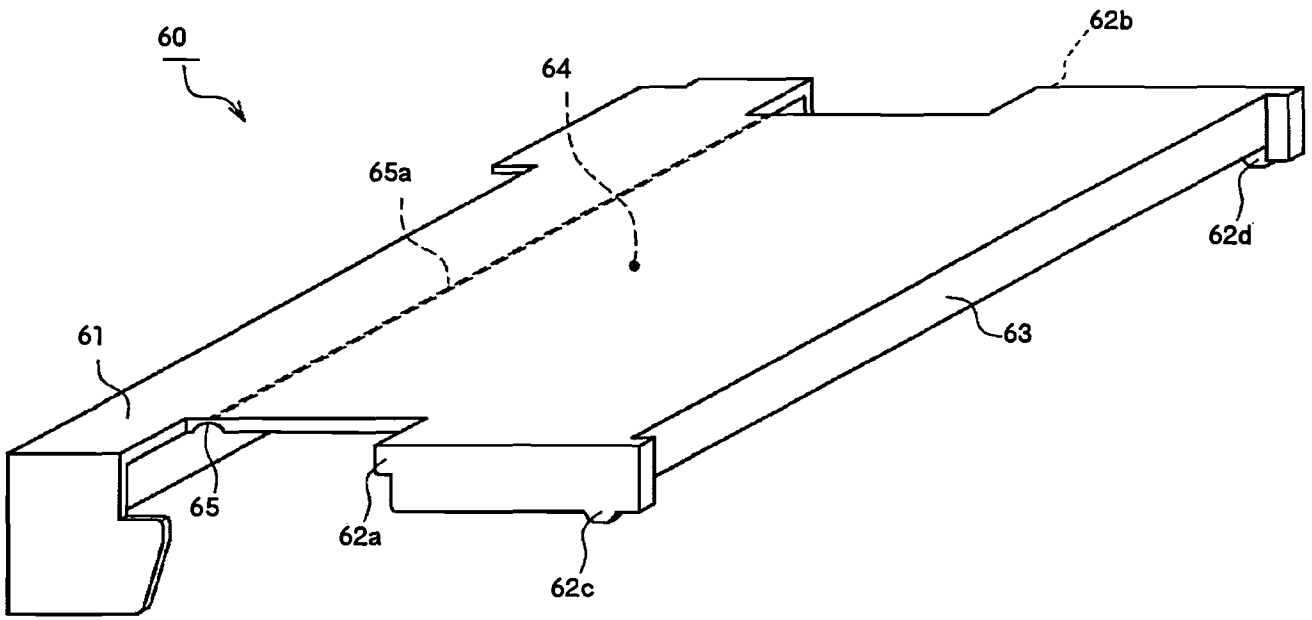
FIG. 9A is a perspective view of a cover component.
Figure 9B:
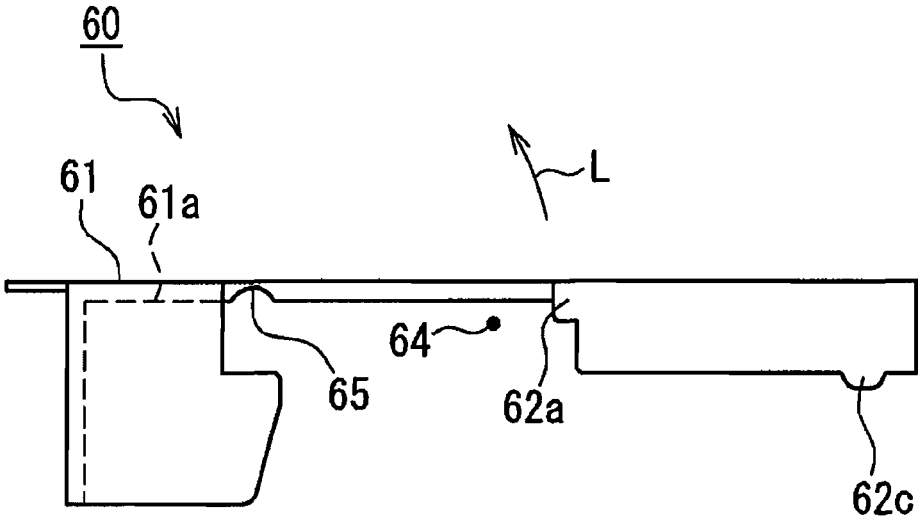
FIG. 9B is a side view of the cover component.

FIG. 9A is a perspective view of the cover component 60. FIG. 9B is a side view of the cover component 60.

In the present embodiment, the cover component 60 is formed of a resin. However, the cover component 60 may be formed of a metal. The cover component 60 includes a fixing section 61, a first restraining section 62*a*, a second restraining section 62*b* (which is not shown in FIG. 9A and FIG. 9B), a third restraining section 62*c*, a fourth restraining section 62*d*, a wall portion 63, and a thickness-reduced portion 65.

The fixing section 61 is secured so as to cover the top surface 31*b* (see FIG. 3A) of the first connector body 31. The fixing section 61 may be secured by an inner surface 61*a* thereof being secured to the top surface 31*b* of the first connector body 31 by using an adhesive, a double-sided adhesive tape, or the like. However, the fixing manner is not limited thereto.

The first restraining section 62*a* is positioned near the locking portion 33*b* of the first holding component 33 when the cover component 60 is secured in the normal position of the first connector body 31. The first restraining section 62*a* restrains the first holding component 33 from being elastically deformed in the direction in which the memory module 20 is disengaged from the locking portion 33*b*. The second restraining section 62*b* is positioned near the locking portion 34*b* of the second holding component 34 when the cover component 60 is secured in the normal position of the first connector body 31. The second restraining section 62*b* restrains the second holding component 34 from being elastically deformed in the direction in which the memory module 20 is disengaged from the locking portion 34*b*. The first restraining section 62*a* and the second restraining section 62*b* are opposed to each other so as to form an internal space 64 therebetween.

The third restraining section 62*c* is positioned near the locking portion 35*b* of the third holding component 35 when the cover component 60 is secured in the normal position of the first connector body 31. The third restraining section 62*c* restrains the third holding component 35 from being elastically deformed in the direction in which the memory module 50 is disengaged from the locking portion 35*b*. The fourth restraining section 62*d* is positioned near the locking portion 36*b* of the fourth holding component 36 when the cover component 60 is secured in the normal position of the first connector body 31. The fourth restraining section 62*d* restrains the fourth holding component 36 from being elastically deformed in the direction in which the memory module 50 is disengaged from the locking portion 36*b*. The third restraining section 62*c* and the fourth restraining section 62*d* are opposed to each other so as to form the internal space 64 therebetween.

The wall portion 63 can prevent, when the cover component 60 is secured in the normal position of the first connector body 31, the memory module 20 which is mounted to the first connector body 31 and positioned in the internal space 64 from being displaced in the direction in which the memory module 20 is detached from the first connector body 31. When the memory module 20 is assuredly held at the contacts 31*a*, the wall portion 63 may not be provided.

The thickness-reduced portion 65 is formed so as to extend from one of end portions of the cover component 60 to the other of the end portions thereof along a dashed line 65*a* indicated in FIG. 9A. In the present embodiment, the thickness-reduced portion 65 is continuously formed along the dashed line 65*a*. The cover component 60 can be bent in a direction indicated by an arrow L (see FIG. 9B) on the thickness-reduced portion 65.

Hereinafter, a structure and a method for causing each restraining section of the cover component 60 to cancel the restraining operation by using the lid component 11 will be described.

The thickness-reduced portion 65 of the cover component 60 can be bent in a restorable manner. In the cover component 60, a side wall from which the first restraining section 62*a* and the third restraining section 62*c* project acts as a lateral restraining section 66, and a side wall from which the second restraining section 62*b* and the fourth restraining section 62*d* project acts as a lateral restraining section 67. In the fixing section 61, a side wall on the lateral restraining section 66 side acts as a lateral fixing section 68, and a side wall on the lateral restraining section 67 side acts as a lateral fixing section 69. The thickness-reduced portion 65 is bent along the dashed line 65*a* as described above. The cover component 60 is deformed between an opened state and a closed state according to a bending state at the thickness-reduced portion 65. The cover component 60 has a restoring force with which to bend upward of the fixing section 61 so as to pivot about the dashed line 65*a* of the thickness-reduced portion 65 in a state where no vertically-pressing-down external force is applied in the direction of the internal space 64. This state represents an opened state. On the other hand, a vertically-pressing-down external force is applied in the direction of the internal space 64 in a state where the cover component 60 is covered with the lid component 11. Thus, the cover component 60 becomes almost coplanar with the fixing section 61 as compared to in the opened state. This state represents a closed state.

Figure 9C:
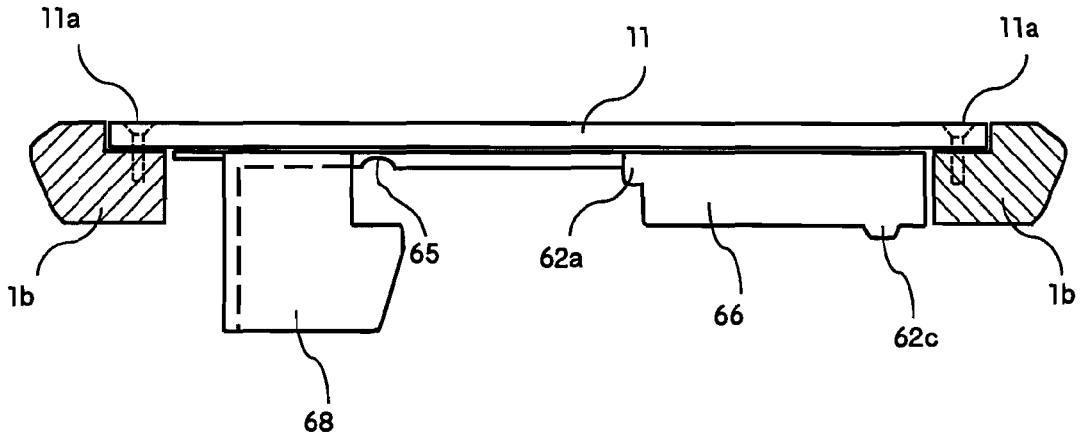
FIG. 9C is a side view of a main portion of the cover component in a covered state.

FIG. 9C is a cross-sectional view illustrating a state in which the lid component 11 covers the opening 10 by the lid component 11 being secured to the opening 10 by screws 11*a*. The lid component 11 maintains the shape of the cover component 60 so as to be in the closed state, when the opening 10 is covered. The lateral restraining sections 66 and 67 of the cover component 60 are regulated, by the lid component 11, in positions at which the lateral restraining sections 66 and 67 are to be regulated, in a state where the lid component 11 covers the opening 10, such that a line of intersection between the lateral fixing section 68 and the fixing section 61 and a line of intersection between the lateral fixing section 69 and the fixing section 61 are substantially aligned with the upper side edges of the lateral restraining sections 66 and 67, respectively.

Figure 9D:
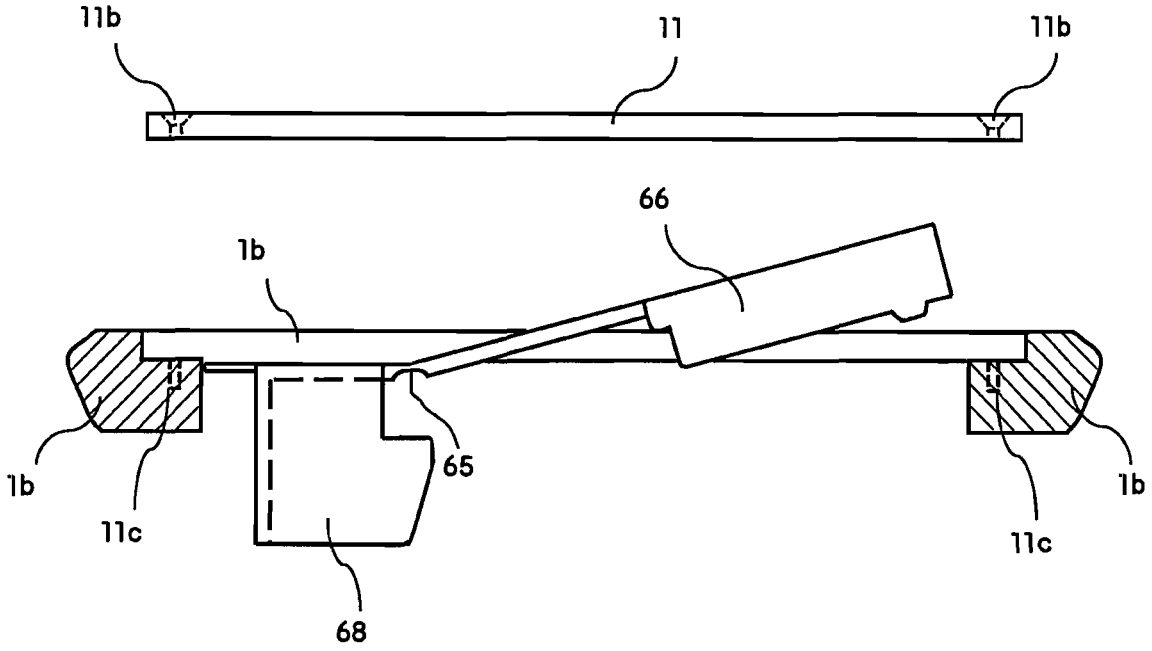
FIG. 9D is a side view of the main portion of the cover component in an uncovered state.

FIG. 9D is a cross-sectional view illustrating a state in which the screws 11*a* are unscrewed, screw holes 11*b* of the lid component 11 and screw holes 11*c* of the bottom surface 1*b* are exposed, and the opening 10 is not covered by the lid component 11. When the lid component 11 is removed, the shape of the cover portion 60 is restored to the opened state. The lateral restraining sections 66 and 67 of the cover component 60 are positioned, when are not regulated by the lid component 11, in positions in which the lateral restraining sections 66 and 67 are not regulated. Namely, a portion of each of the lateral restraining sections 66 and 67 projects, beyond the opening 10, from the bottom surface 1*b*, due to bending on the dashed line 65*a* of the thickness-reduced portion 65. Further, portions which project beyond the opening 10 from the bottom surface 1*b* are on the side on which the memory module 20 or 50 is inserted. Therefore, addition or exchange is facilitated.

The cover component 60 which can be easily bent may be formed by, for example, a spring hinge being used therein, as well as by the thickness-reduced portion 65 being formed by a method for processing a part of the cover component 60 so as to have a reduced thickness.

As described above, in a case where restraining the cover component 60 from bending is canceled by using the lid component 11, when a user of the notebook computer removes the lid component 11, a restrained state of the memory module 20 can be simultaneously canceled. Therefore, this is convenient for replacing the memory module 20.

Figure 10A:
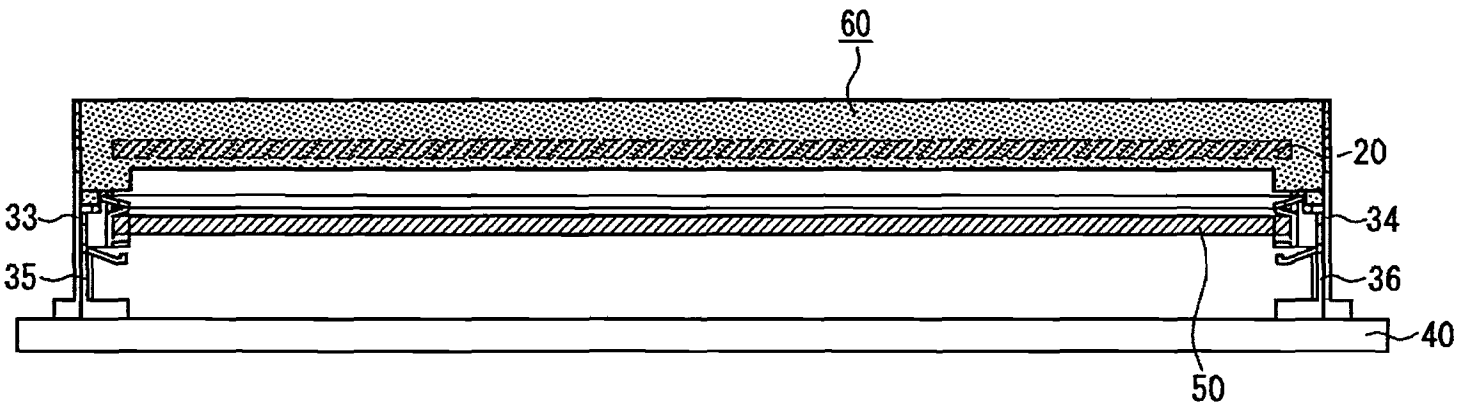
FIG. 10A is a front view of the connector device to which the cover component is mounted.
Figure 10B:
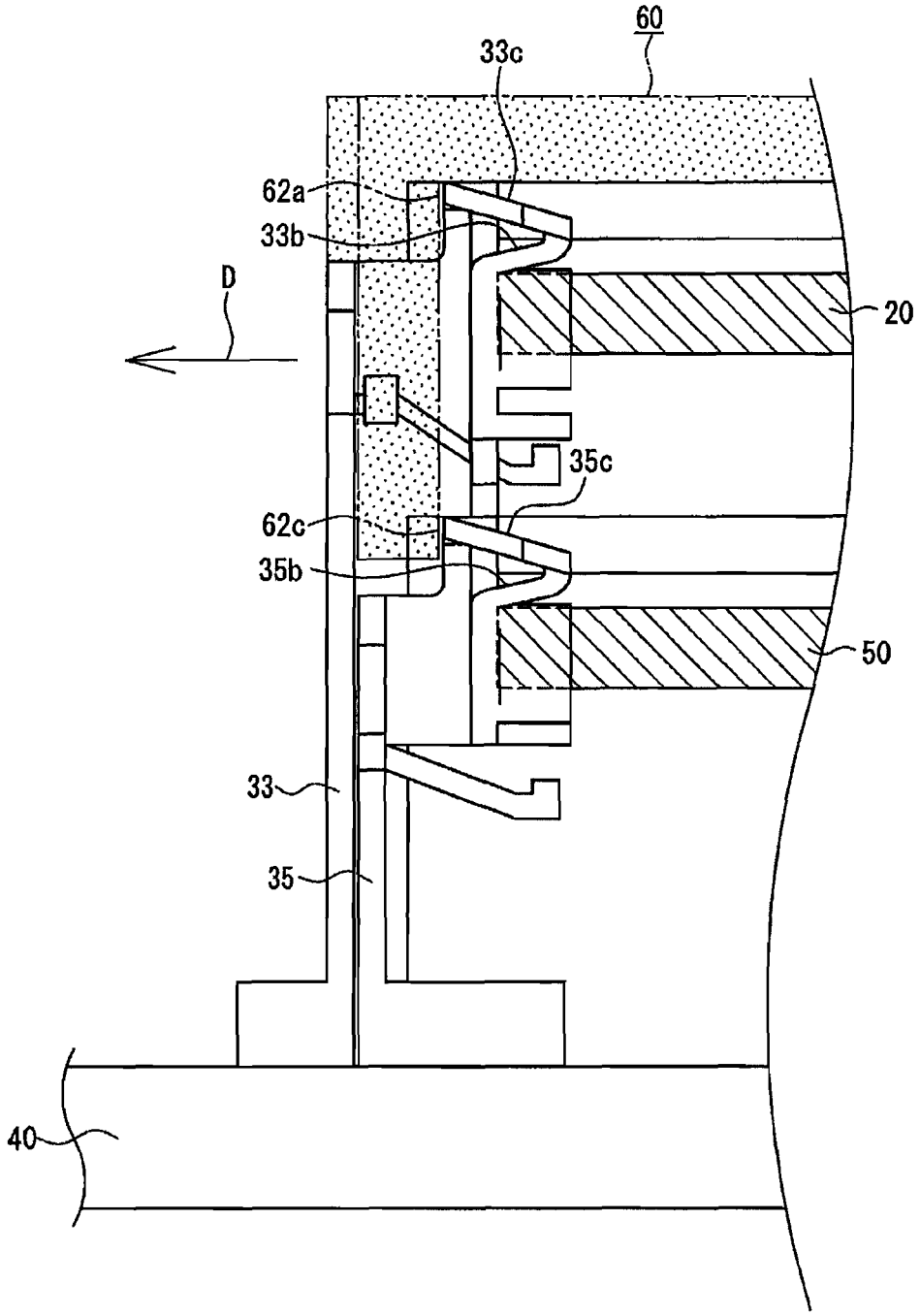
FIG. 10B is an enlarged cross-sectional view of the connector device to which the cover component is mounted.
Figure 10C:
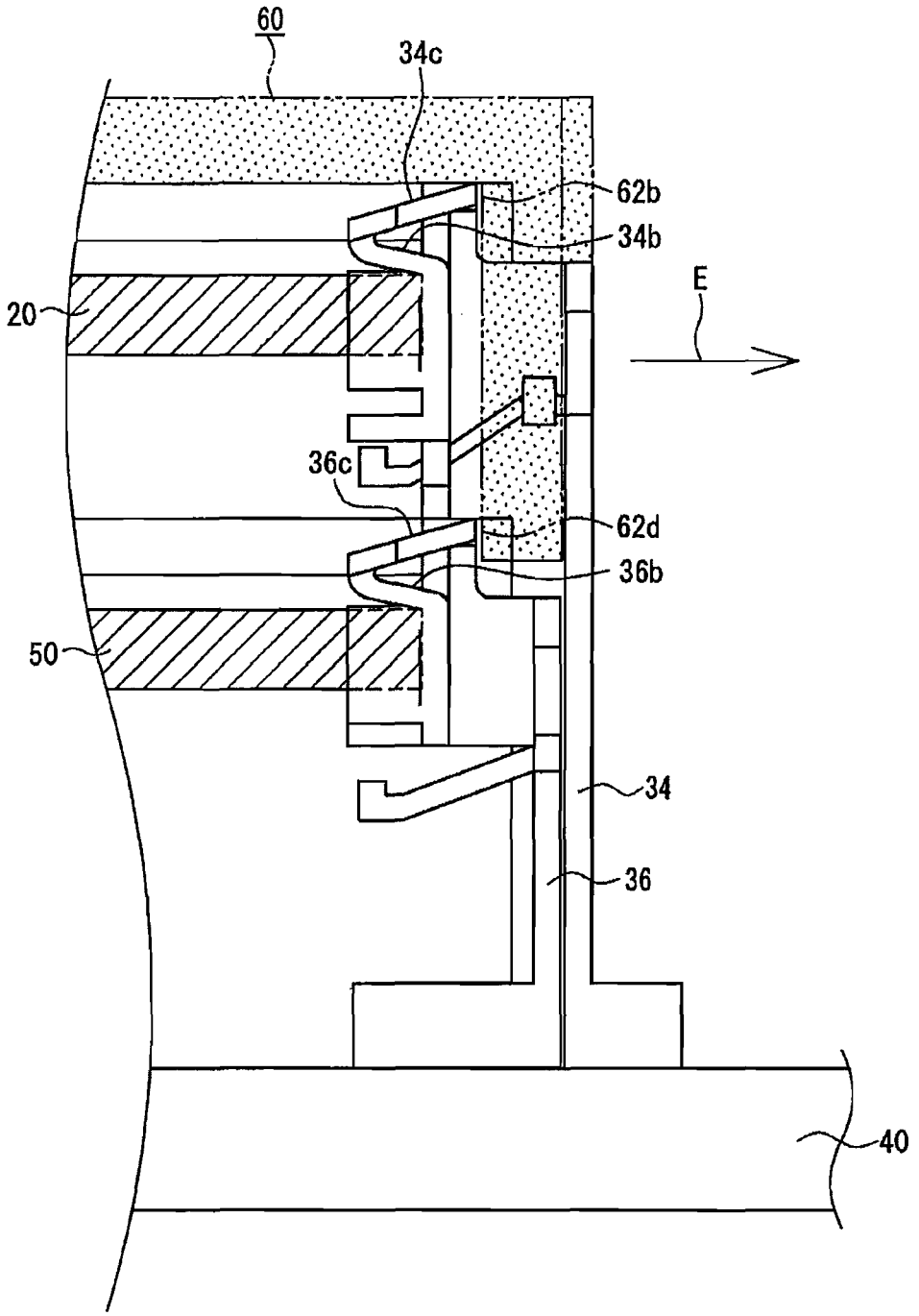
FIG. 10C is an enlarged cross-sectional view of the connector device to which the cover component is mounted.

FIG. 10A is a front view illustrating a state in which the cover component 60 is mounted to the connector device 30. FIG. 10B is an enlarged cross-sectional view of a vicinity of the first holding component 33 and the third holding component 35 of the connector device 30. FIG. 10C is an enlarged cross-sectional view of a vicinity of the second holding component 34 and the fourth holding component 36 of the connector device 30. In FIG. 10B, the cover component 60 is represented by a virtual line in order to clearly indicate a positional relationship among the first holding component 33, the third holding component 35, and the cover component 60. Further, in FIG. 10C, the cover component 60 is represented by a virtual line in order to clearly indicate a positional relationship among the second holding component 34, the fourth holding component 36, and the cover component 60.

As shown in FIG. 10B, the first restraining section 62*a* of the cover component 60 is positioned outside the operation piece 33*c* and the locking portion 33*b* of the first holding component 33, to restrain the first holding component 33 from being displaced in the direction indicated by the arrow D. The third restraining section 62*c* of the cover component 60 is positioned outside the operation piece 35*c* and the locking portion 35*b* of the third holding component 35, to restrain the third holding component 35 from being displaced in the direction indicated by the arrow D.

As shown in FIG. 10C, the second restraining section 62*b* of the cover component 60 is positioned outside the operation piece 34*c* and the locking portion 34*b* of the second holding component 34, to restrain the second holding component 34 from being displaced in the direction indicated by the arrow E. The fourth restraining section 62*d* of the cover component 60 is positioned outside the operation piece 36*c* and the locking portion 36*b* of the fourth holding component 36, to restrain the fourth holding component 36 from being displaced in the direction indicated by the arrow E.

As described above, the cover component 60 can restrain displacements of the first holding component 33, the second holding component 34, the third holding component 35, and the fourth holding component 36.

[4. Effects of Embodiment and Others]

According to the present embodiment, since the connector device 30 has the cover component 60 mounted thereto, and the cover component 60 includes the first restraining section 62*a* and the second restraining section 62*b*, displacements of the first holding component 33 and the second holding component 34 can be restrained. Therefore, even if the connector device 30 is subjected to impact or shaking from the outside, the first holding component 33 and the second holding component 34 are not disengaged from the memory module 20, and easy detachment of the memory module 20 from the first connector body 31 can be prevented.

According to the present embodiment, since the cover component 60 includes the third restraining section 62*c* and the fourth restraining section 62*d*, displacements of the third holding component 35 and the fourth holding component 36 can be restrained. Therefore, even if the connector device 30 is subjected to impact or shaking from the outside, the third holding component 35 and the fourth holding component 36 are not disengaged from the memory module 50, and easy detachment of the memory module 50 from the second connector body 32 can be prevented.

According to the present embodiment, since the cover component 60 includes the first restraining section 62*a*, the second restraining section 62*b*, the third restraining section 62*c*, and the fourth restraining section 62*d*, one cover component 60 can prevent detachments of two memory modules. Therefore, the number of components can be reduced, thereby realizing cost reduction. Further, since the first holding component 33, the second holding component 34, the third holding component 35, and the fourth holding component 36 can be easily aligned with the cover component 60, assembly workability of a device that has the connector device 30 and the cover component 60 can be enhanced.

According to the present embodiment, since the cover component 60 is directly secured to the first connector body 31, a space is unnecessary for securing the cover component 60 to the printed board 40, thereby reducing the size of the printed board 40.

According to the present embodiment, the cover component 60 is used to prevent detachments of two memory modules. However, when the number of restraining sections of the cover component 60 is increased, detachments of three or more memory modules can be prevented.

Further, according to the present embodiment, a memory module is described as a circuit module which can be mounted to the connector device 30. However, the present disclosure is applicable to other circuit modules such as a communication module.

Further, according to the present embodiment, the cover component 60 is formed of a resin. However, the cover component 60 may be formed of a material, such as a metal, excellent in thermal conductivity. Thus, heat from the memory module 20 can be dissipated with an enhanced effectiveness, thereby enabling an operation of the memory module 20 to be stabilized.

Further, a heat dissipation plate may be disposed between the cover component 60 and the memory module 20. Thus, heat from the memory module 20 can be dissipated with an enhanced effectiveness, thereby enabling an operation of the memory module 20 to be stabilized.

Figure 11:
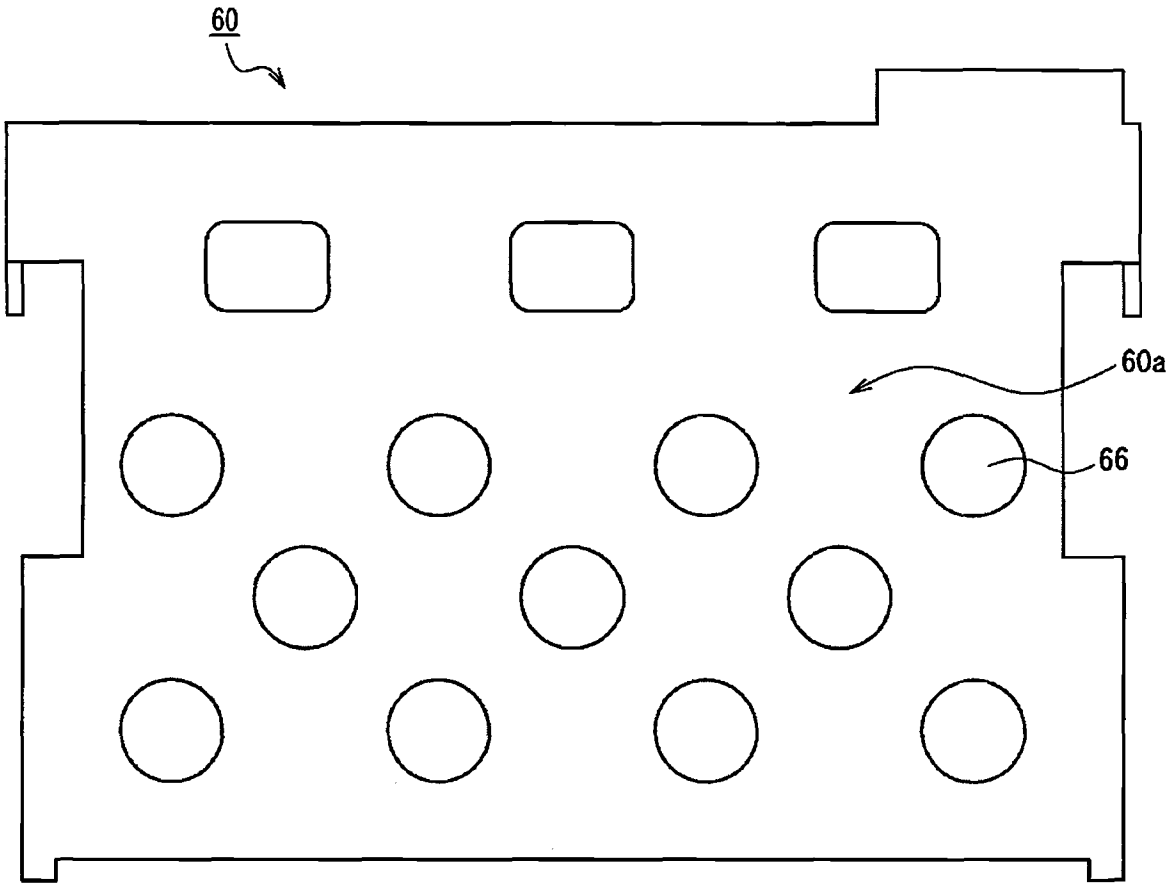
FIG. 11 is a plan view illustrating a modification of the cover component.

Further, as shown in FIG. 11, through holes 66 may be formed so as to extend from a top surface 60*a* of the cover component 60 through the back surface thereof. When the through holes 66 are formed, heat generated when the memory module 20 is operating can be dissipated to the outside, thereby enabling an operation of the memory module 20 to be stabilized.

Further, according to the present embodiment, the cover component 60 is separated from the connector device 30 or the first connector body 31. However, the cover component 60 may be integrated with the connector device 30 or the first connector body 31.

Further, the memory modules 20 and 50 according to the present embodiment are each an example of a subject to be connected. The first connector body 31 and the second connector body according to the present embodiment are each an example of a connector body. The contacts 31*a* and 32*a* according to the present embodiment are each an example of an electrical contact. The first locking portion 33*b*, the second locking portion 34*b*, the third locking portion 35*b*, and the fourth locking portion 36*b* according to the present embodiment are each an example of a locking portion. The first holding component 33, the second holding component 34, the third holding component 35, and the fourth holding component 36 according to the present embodiment are examples of holding components. The connector device 30 according to the present embodiment is an example of a connector device. The cover component 60 according to the present embodiment is an example of a detachment prevention component. The fixing section 61 according to the present embodiment is an example of a fixing section. The first restraining section 62*a*, the second restraining section 62*b*, the third restraining section 62*c*, and the fourth restraining section 62*d* according to the present embodiment are each an example of a restraining section.

What is claimed is:

1. A detachment prevention component which is mountable to a connector device that includes: a connector body capable of holding a subject to be connected; an electrical contact, included in the connector body, having an elasticity with which the subject to be connected can be urged in a disconnection direction; and at least a pair of holding components, included in the connector body, each having a locking portion for restraining the subject to be connected from moving in the disconnection direction, the detachment prevention component comprising:

a fixing section secured to the connector body; and a restraining section for restraining displacement of the holding components in a direction in which the locking portion disengages from the subject to be connected, wherein the detachment prevention component is mountable to the connector device that includes plural sets of holding components, and the restraining section includes holding members, one of the holding members restraining displacement of the holding components on one side in each set, and the other of the holding members restraining displacement of the holding components on the other side in each set.

2. An electronic device comprising:

a casing;

a connector body, disposed in the casing, capable of holding a subject to be connected;

a lid component, disposed on an outer surface of the casing so as to be openable and closable, for covering the connector body in a closed state;

an electrical contact, included in the connector body, having an elasticity with which the subject to be connected can be urged in a disconnection direction;

at least a pair of holding components, included in the connector body, each having a locking portion for restraining the subject to be connected from moving in the disconnection direction; and a detachment prevention component secured to the connector body, wherein the detachment prevention component includes:

a fixing section secured to the connector body; and a restraining section for restraining displacement of the holding components in a direction in which the locking portion disengages from the subject to be connected, and the locking portion cancels the restraining of the displacement when the lid component is in an opened state.

3. The electronic device according to claim 2, comprising plural sets of holding components, wherein the restraining section includes holding members, one of the holding members restraining displacement of the holding components on one side in each set, and the other of the holding members restraining displacement of the holding components on the other side in each set.

* * * * *